United States Patent [19]

Schone et al.

[11] 4,188,883

[45] Feb. 19, 1980

[54] ROTARY PRINTING MACHINE

[75] Inventors: Helmut Schöne; Hans Johne; Alfred Schott, all of Radebeul; Horst Schulz; Otfried Rudolh, both of Dresden, all of German Democratic Rep.

[73] Assignee: VEB Polygraph Leipzig Kombinat für Polygraphische Maschinen und Ausrustüngen, Leipzig, German Democratic Rep.

[21] Appl. No.: 907,392

[22] Filed: May 18, 1978

Related U.S. Application Data

[63] Continuation of Ser. No. 753,482, Dec. 22, 1976, abandoned.

[51] Int. Cl.[2] ..... B41F 5/02; B41F 21/00

[52] U.S. Cl. ..... 101/183; 101/230

[58] Field of Search ..... 101/183, 184, 185, 229, 101/230, 231, 136, 137, 416 R, 416 A; 271/184, 225, 69, 82, DIG. 9

[56] References Cited

U.S. PATENT DOCUMENTS

| | | | |
|---|---|---|---|
| 2,100,852 | 11/1937 | Jacobson | 101/177 X |
| 2,174,864 | 10/1939 | Barber | 101/416 R X |
| 2,898,851 | 8/1959 | Peyrebrune | 101/136 |
| 2,940,387 | 6/1960 | Pritchard | 101/183 |
| 3,537,391 | 11/1970 | Mowry | 101/246 |
| 3,611,925 | 10/1971 | Kulwicki | 101/183 |
| 3,772,990 | 11/1973 | Weisgerber | 101/183 X |
| 3,918,363 | 11/1975 | Southam et al. | 101/183 |
| 3,949,670 | 4/1976 | Katsuji | 101/183 |
| 3,960,079 | 6/1976 | Capetti | 101/183 |
| 4,000,691 | 1/1977 | Fischer | 101/183 |

FOREIGN PATENT DOCUMENTS

| | | | |
|---|---|---|---|
| 1065159 | 4/1967 | United Kingdom | 101/136 |

*Primary Examiner*—J. Reed Fisher
*Attorney, Agent, or Firm*—Michael J. Striker

[57] ABSTRACT

A rotary printing machine has at least two successive printing stations. A self-contained aggregate is located between these printing stations and can be inserted and removed from between them as a unit. The aggregate has a transfer roller which receives sheets from one of the printing stations, one or more heaters for heating the sheets on the transfer roller, and a reversing roller which receives sheets from the transfer roller, selectively reverses them and furnishes them to the other of the printing stations.

6 Claims, 5 Drawing Figures

ROTARY PRINTING MACHINE

CROSS-REFERENCE TO A RELATED APPLICATION

The present application is a continuation of the application Ser. No. 753,482, filed Dec. 22, 1976, now abandoned.

BACKGROUND OF THE INVENTION

This invention relates to printing machines generally, and more particularly to rotary sheet printing machines.

Still more particularly, the invention relates to rotary sheet printing machines which are equipped for selectively printing on the obverse side of a sheet or on the obverse and reverse side thereof.

Machines of the general type in question are known. For example German Democratic Republic Patent No. 54,704 discloses a rotary printing machine having a pair of printing stations between which there is either located a transfer roller or a reversing roller. If the machine is to print only the obverse side of a sheet, it comes equipped with a transfer roller which simply passes the sheet from one to the other of the printing stations, both of which print on its obverse side. If the machine is to print on the obverse and reverse sides—i.e. perfection printing—it comes additionally equipped with a reversing roller which receives the sheet from one printing station which has printed on the obverse side, reverses the sheet and presents it to the other printing station in readiness for printing by the same on the reverse side.

Analogous printing machines are disclosed in U.S. Pat. Nos. 3,537,391 to Mowry and 2,757,610 to H. W. Gegenheimer et al, except that Gegenheimer et al discloses a machine having three rollers of which one is a reversing roller and which are all three located between the printing cylinders of two successive printing stations, whereas GDR Patent No. 54,704 and Mowry each disclose a single roller which operates as a reversing roller and is located between the printing cylinders of two successive printing stations.

These machines are basically satisfactory. However, further improvements are needed because of economic and operational considerations.

When prior-art machines are used for high-speed obverse-reverse printing, there is insufficient time to dry the ink applied to the obverse sheet side before this side, upon reversal of the sheet, comes into contact with the rollers of the next-following printing station. The inherent—and inevitable—result is a deterioration of the print quality on the obverse side. This is evidently undesirable and, in the case of perfection printing, completely unacceptable. Yet, economic and other considerations dictate ever higher printing speeds, so that this problem is becoming more and more prevalent.

In addition, economic considerations, also play a part in the manufacture of such machines. Depending upon whether the machines are to be used only for obverse printing, or for obverse-reverse printing, they are equipped with either only a sheet transfer roller or with an addional sheet reversing roller, as already explained. These rollers are an integral part of the respective machine. The different machines must be built on different assembly lines because the type of intermediate roller used—i.e. whether a sheet-transfer or a sheet-reversing roller—influences the construction of the printing stations, meaning that printing stations which cooperate with a reversing roller will be structurally different from those which cooperate with a transfer roller. This increases the construction cost and makes it difficult to change manufacturing dispositions in accordance with changes in customer instructions which are often received on short notice.

Also, if the machine employs a sheet reversing roller which is of the type that engages the trailing edge of the sheet received from the upstream printing station, it requires special devices to assure that there will be an adequate sheet length between the successive printing stations. This is necessary because it must be assumed that at the moment at which the trailing sheet edge is gripped by the gripper mechanism, the leading sheet edge has not yet entered the nip between the sheet reversing roller and the output roller of the upstream (i.e. preceding) printing station, since damage to the sheet is otherwise likely to result.

SUMMARY OF THE INVENTION

Accordingly, it is a general object of the invention to avoid the disadvantages outlined above.

More particularly, it is an object of the invention to provide an improved rotary sheet printing machine which avoids these disadvantages.

Another object is to provide such an improved machine which is capable of carrying out any desired type of rotary printing—e.g. multi-color obverse printing, multi-color obverse-reverse printing—in a single pass of the sheet through the machine and without having to accept any quality-deterioration whatever.

A concomitant object of the invention is to provide a machine of this type wherein the free sheet length required for proper sheet reversal is assured without the need for special devices.

Still a further object is to provide such a machine wherein all of the printing stations can be of the same construction, irrespective of whether the machine serves for obverse or for obverse-reverse printing.

In keeping with these objects and with others which will become apparent hereafter, the invention resides in a rotary sheet-printing machine of the type having at least two successive printing stations and means for transferring a sheet from one to the other of the printing stations and for selectively reversing the sheet during the transfer, the improvement wherein the means comprises a self-contained aggregate which can be installed and removed from between the printing stations as a unit, and drying means on the aggregate for drying the sheet prior to transfer thereof to the other printing station.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
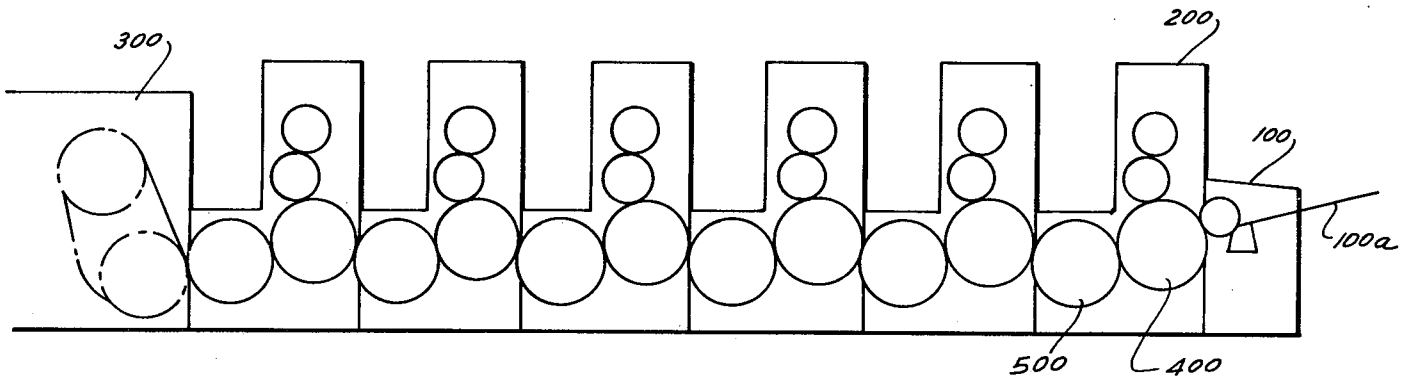
FIG. 1 is a diagrammatic side view of a prior-art rotary sheet-printing machine.

FIG. 1 shows a prior-art rotary sheet-printing machine which has a sheet feeder 100 with a feed table 100*a*, a plurality (here six) of printing stations 200 through which the sheets pass in succession, and a sheet output device 300.

Each of the printing stations 200 has a printing cylinder 400 and a sheet-transfer roller 500 which transfers the sheet—after printing by the printing cylinder 400–to the printing cylinder 400 of the next-following printing station 200. Preferably, and as illustrated, the diameters of cylinder 400 and roller 500 are identical to obtain a more uniform sheet movement. The machine of FIG. 1 can also be constructed as a perfecting printer, in which case it must be equipped with a sheet-reversing roller (similar to roller 10 of the Mowry patent) in place of the transfer roller 500. Sheet-reversing rollers require that the output roller of the printing station from which they receive the sheet, and that roller of the next station to which they deliver the sheet, be constructed differently from when a simple transfer roller is used, i.e. the output roller is constructed as a transfer roller. Hence, the machine will then be structurally and functionally different from the version which is equipped with a sheet transfer roller, and different printing station structure will be required.

Figure 5:
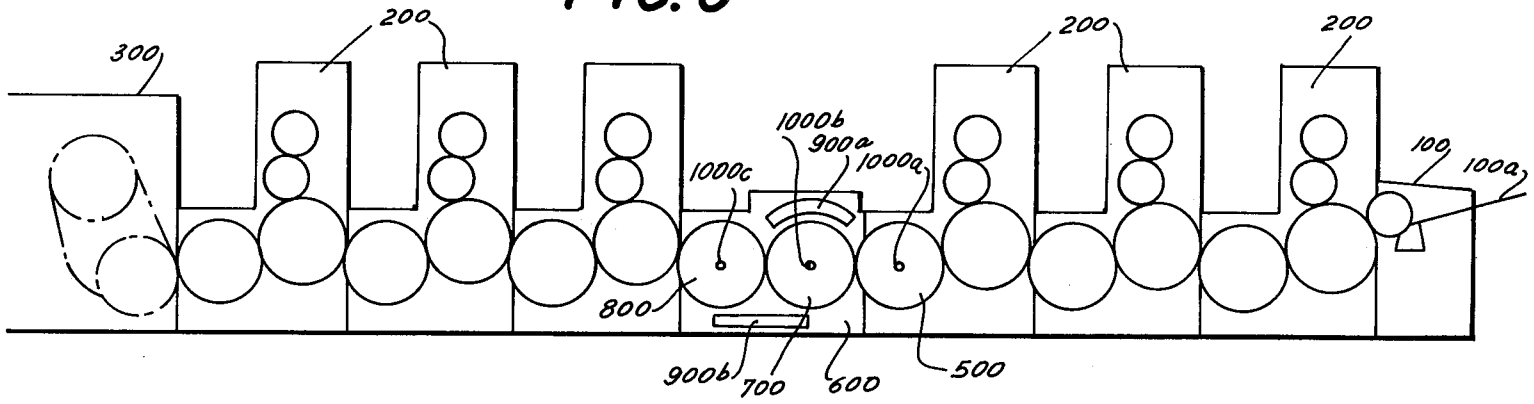
FIG. 5 is a view similar to FIG. 1, but illustrating a machine embodying the present invention.
Figure 2:
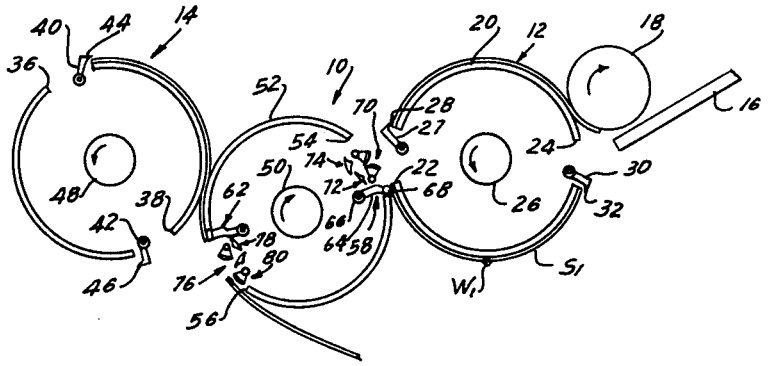
FIG. 2 is a diagrammatic view of the details of the prior-art machine, showing the components in a first operating position.
Figure 3:
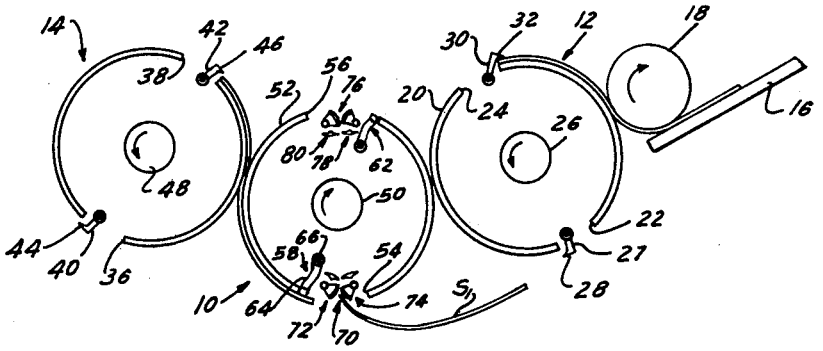
FIG. 3 is a view similar to FIG. 2, but showing the components in a different second operating position.
Figure 4:
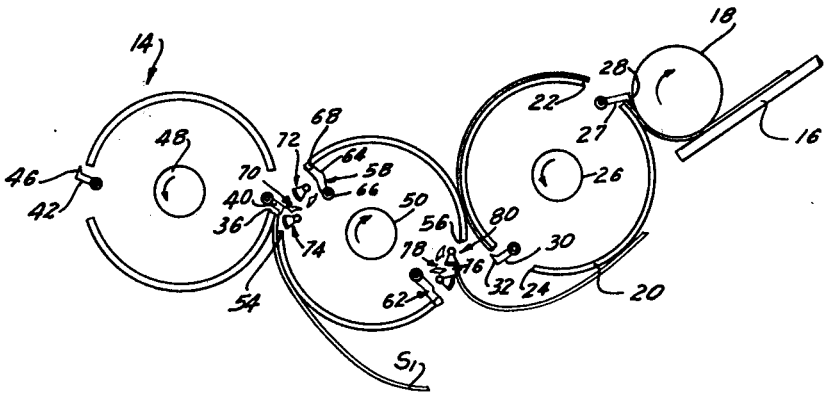
FIG. 4 is another view similar to FIG. 2, but showing the components in a different third operating position.

By way of explanation, FIGS. 2–4 illustrate the operation and construction of a similar machine when it is supplied as a perfecting printer, i.e. when it reverses the sheets when passing them to the successive printing stations. It should be understood that the details shown in FIGS. 2 and 4 are of a somewhat different machine than the one of FIG. 1, but can be used in that machine also and that the structures relating to the gripper and general sheet handling mechanisms can equally well be used in the machine according to the present invention, as illustrated in FIG. 5, but that they are already known per se.

FIGS. 2, 3 and 4 show a perfecting cylinder generally designated by the numeral 10 with a first impression cylinder 12 positioned adjacent thereto and a second impression cylinder 14 positioned on the opposite side of the perfecting cylinder 10. A feed table 16 is positioned adjacent to a pick up cylinder 18 that feeds the sheets to the first impression cylinder 12. A conventional printing couple consisting of a plate cylinder and a blanket cylinder with suitable inkers and dampening units are associated with the first impression cylinder 12 and have been omitted from the drawings to more clearly illustrate the invention. A similar printing couple is associated with the second impression cylinder 14 and has not been shown for the same reason. It should be understood, however, that any conventional well known printing couple such as that illustrated in FIGS. 1 and 2 of Gegenheimer et al, U.S. Pat. No. 2,757,610, could be used with the cylinders 12 and 14.

The impression cylinder 12 has a cylindrical surface 20 with a first longitudinal opening 22 and a diametrically opposite second longitudinal opening 24. The impression cylinder 12 may be of conventional well known construction and is suitably supported for rotation on shaft 26. A first set of grippers 27, only one of which is illustrated in FIGS. 2–4 is secured to a shaft within the cylinder 12 and have gripper fingers 28 arranged to engage the leading edge of the sheet and maintain the leading edge of the sheet in registry on the impression cylinder 12 while an upper surface of the sheet is printed. The first impression cylinder 12 has a second set of grippers 30 mounted on a shaft in recessed portion 24 with gripper fingers 32 arranged to engage the front edge of a second sheet and maintain the front edge of the sheet in registry while the sheet is being printed. The grippers 27 and 30 are of conventional construction and suitable sets of grippers and actuating means therefore are illustrated in the Gegenheimer et al. patent.

The second impression cylinder 14 is similar to the first impression cylinder 12 and includes a cylindrical surface with a first recessed portion or opening 36 and a diametrically opposed other recessed opening 38. Grippers 40 and 42 are rotatably secured within the impression cylinder 14 and have gripper fingers 44 and 46 that abut the peripheral surface of the cylinder 14 and are operable to engage the leading edge of a sheet to the periphery of the second impression cylinder 14. The second impression cylinder 14 is suitably mounted on a shaft 48 for rotation in timed relation with both the first impression cylinder 12 and the perfecting cylinder 10.

In FIGS. 2–4, only one set of diametrically opposite grippers are illustrated on each impression cylinder. It should be understood however, that a plurality of grippers extend longitudinally along the periphery of the cylinder surfaces 20 and 24 and the respective grippers on each cylinder are arranged to simultaneously engage the leading edge of the sheet and firmly secure the leading edge of the sheet to the surface of the impression cylinder while the sheet is being printed and either transferred to the perfecting cylinder or transferred to a suitable sheet delivery mechanism.

The perfecting cylinder 10 is suitably mounted on a shaft 50 for timed rotation with the impression cylinders 12 and 14. The perfecting cylinder 10 is illustrated as having a cylindrical surface 53 with a first recessed portion 54 and a diametrically opposed recessed portion 56. The perfecting cylinder 10 could also be fabricated from a plurality of disklike members as is disclosed in the Gegenheimer et al. patent. Positioned within the recess 54 are a plurality of suction devices 58 spaced longitudinally along the cylinder periphery 52. In FIG. 2, the suction devices 58 extend into slots 60 that extend radially from the recessed portion 54. The slots 60 provide for movement of the suction devices along the periphery 52 of perfecting cylinder 10. Similar suction devices 62 extend outwardly from the cylinder 10 and terminate along the peripheral surface 52. The suction devices 58 and 62 are similar in construction and only the suction devices 58 will be described in detail since the suction devices 62 operate in substantially the same manner. The suction devices 58 have an arm portion 61 nonrotatably secured to a shaft 66 extending longitudinally within the perfecting cylinder 10. The arm portions 64 terminate in a head portion 68 that has a foraminous or perforated outer end portion that terminates at the periphery of the perfecting cylinder cylindrical surface 52. The suction devices are arranged to move along the periphery of the perfecting cylinder 10 to a limited extent by rotation of shaft 66. The arm portion 64 of suction devices 58 are arranged, upon rotation of shaft 66 in a counterclockwise direction, to abut a stop member (not shown) to thereby limit the rotational movement and position the sheet edge portion for engagement by the perfecting gripper assembly as later described.

An arrangement whereby the suction heads are permitted to move along the periphery of the suction heads and the manner for controlling the movement of the suction head, is also known from the prior art.

The tumbler gripper assemblies are generally designated by the numeral 70 and include a perfecting gripper assembly generally designated by the numeral 72 and a multi-color gripper assembly generally designated by the numeral 74. The perfecting gripper assembly 72 and gripper assembly 74 are arranged to tumble inwardly toward each other and abut stop members and in this position remain within the periphery of the perfecting cylinder 10. The perfecting gripper assembly 72 and gripper assembly 74 are also arranged to tumble outwardly away from each other and beyond the periphery of the perfecting cylinder 10 and abut stop members so that the perfecting grippers can engage the trailing edge of the sheet secured by the suction device 58 on the perfecting cylinder 10 and the grippers 74 can transfer the sheet to the second impression cylinder. The perfecting gripper assembly 72 and assembly 74 may be similar in construction to the perfecting gripper assembly and multi-color gripper assembly illustrated in the Gegenheimer et al. patent. Also, similar apparatus to that illustrated in the Gegenheimer et al. patent for tumbling the gripper assemblies inwardly toward each other and outwardly away from each other may be employed to tumble the perfecting gripper assembly 72 and gripper assembly 74 in the perfecting cylinder.

The perfecting cylinder 10 has a second pair of tumbler gripper assemblies generally designated by the numeral 76 within the recess 56 and diametrically opposed to the tumbler gripper assemblies 70. The tumbler gripper assemblies 76 include a perfecting gripper assembly generally designated 78 and multi-color gripper assembly 80. The perfecting gripper assembly 78 and gripper assembly 80 are similar to the perfecting gripper assembly 72 and gripper assembly 74 and will not be described in detail.

In contrast to the prior-art machine of FIG. 1, the novel machine of FIG. 5 avoids the disadvantages which were outlined in the introductory parts of this description.

The machine of FIG. 5 also uses a plurality of printing stations 200; however, these are always identical, whether normal rotary printing or rotary perfection printing is to be carried out. A feeder 100 with feed table 100*a* and a discharge device 300 are again provided.

Unlike the prior art, however, the machine of FIG. 1 employes a separate aggregate 600 which is self-contained and can be placed as a unit between consecutive printing stations or, of course, can be similarly removed as a unit. This aggregate comprises, as seen in the direction of sheet movement—i.e. in FIG. 5 from right to left—a sheet transfer roller 700 which is followed (in the same direction) by a sheet reversing (i.e. a perfecting) roller 800.

The sheet transfer roller 700, which receives sheets from the preceding printing station 200, and passes them on to the roller 800, thus corresponds in function and construction to the roller 500 of the machine in FIG. 1, which roller is described in FIGS. 2-4 as the impression cylinder 13. Sheet reversing roller 800 has no counterpart in the machine illustrated in FIG. 1, but—if that machine were used for perfection printing—it would be interposed between the transfer roller 500 which then would become the output roller of the printing station, and the input roller of the succeeding printing station. Roller 800 is functionally equivalent to the perfecting cylinder 10 shown in FIGS. 2-4.

Also, a part of the aggregate 600, and in fact an important part, is means for drying the ink on the sheets received by the unit 600. This means comprises at least one drying device; however, in FIG. 5 two such drying devices 900*a* and 900*b* are illustrated. They may be of any known type capable of supplying adequate heat to dry the ink without burning the sheets, e.g. they may be electrically heated, steam heated, or the like. What is important is that they cooperate with the transfer roller 700, i.e. are located ahead of the perfecting roller 800 so that by the time the sheets reach the roller 800 the ink is dry and contact of the printed side with any of the rollers will prevent any quality deterioration of the printed matter.

Preferably, but not as a matter of absolute necessity, the axes of rotation 1000*a*, 1000*b* and 1000*c* of the output roller 200*a* of the upstream printing station, the roller 700 and the roller 300, are located in a common horizontal plane.

Among the important advantages of the machine in FIG. 5 is the fact that the need for heating in association with the printing units 200 themselves is avoided. On the other hand, the provision of the heaters 900*a*, 900*b* (one or more than two may also be used) and their location in the aggregate 600 ahead of the roller 800, assures proper drying of the printing ink so that any kind of printing—up to the extreme of four colors on each sheet side—can now, for the first time, be carried out without any quality deterioration due to contact of the printed matter with the roller surfaces.

A further important advantage resides in the provision of the transfer roller 700, the cooperating reversing roller 800 and the heating devices in an autonomous aggregate. This makes it possible to construct the overall machine with printing stations of identical structure. If only rotary printing is required, the aggregate 600 is not employed and the sheet simply travels from the output roller 500 of the preceding station 200 to the input roller of the next succeeding printing station 200. If, on the other hand, the machine is to be constructed as a perfecting printer, the structure of the printing stations 200 does not change in any way, i.e. it is the same as before. All that is necessary is to place an aggregate 600 between each two successive printing stations 200 where sheet reversal is required. Evidently, this greatly simplifies the expense of constructing the two different kinds of machines, since only a single assembly line is now required and makes for much greater flexibility of the manufacturer in accommodating the wishes of his customers. Also, the resulting ability to construct and use only a single type of printing station for the two different kinds of machines, makes for greater economy in stock-keeping and manufacture. Finally, the free sheet length required for sheet reversal of the type where the trailing sheet edge is engaged to initiate the reversing movement, is assured without requiring special devices for this purpose.

It will be understood that each of the elements described above, or two or more together, may also find a useful application in other types of machines differing from the types described above.

While the invention has been illustrated and described as embodied in a rotary printing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a rotary sheet-printing machine, a combination comprising at least two successive printing stations which are identical with one another and which each have a sheet input roller and a sheet output roller; a detachable self-contained aggregate comprising a sheet transfer roller adapted to receive sheets from said output roller of the upstream one of said printing stations and to transfer such sheets to the input roller of the downstream one of said printing stations, and a sheet reversing roller downstream of said transfer roller for selectively reversing the sheets during transfer, said aggregate being installable and removable from between said printing stations as a unit so that when said aggregate is removed said output roller of the upstream printing station supplies the sheets directly to said input roller of the downstream printing station, and thereby the machine is turned into an operable observe-printing machine without requiring any modifications to said printing stations and with maintaining the stations identical, whereas when said aggregate is installed, the operation of said two successive printing stations is again not influenced but said output roller of the upstream printing station supplies the sheets to said transfer roller of the aggregate for transfer to and reversing by said reversing roller which then supplies the reversed sheets to said input roller of the downstream printing station, and thereby the machine is turned into an operable perfection-printing machine also without requiring any modifications to said printing stations and with maintaining both stations identical; and drying means for drying the sheets prior to transfer thereof to said input roller of the downstream printing station.

2. A combination as defined in claim 1, wherein said sheet input rollers of said two printing stations rotate in a first direction and said sheet output roller rotate in a second direction which is opposite to said first direction when said aggregate is installed between said printing stations, said sheet input rollers and said sheet output rollers rotating in the same respective directions when said aggregate is removed from between said printing stations.

3. A combination as defined in claim 1, wherein said drying means comprises at least one heater for drying the sheet while the same is on said transfer roller.

4. A combination as defined in claim 1, wherein said output roller of said one printing station has a diameter which is substantially equal to the diameter of said transfer roller and said reversing roller of said aggregate.

5. A combination as defined in claim 1, wherein the axes of said output rollers, said transfer roller and said reversing roller are all located in a common plane.

6. A combination as defined in claim 5, wherein said axes of said rollers are located in a common horizontal plane.

* * * * *